United States Patent [19]

Anderson

[11] Patent Number: 4,701,055

[45] Date of Patent: Oct. 20, 1987

[54] MIXING APPARATUS

[75] Inventor: Marvin H. Anderson, Denver, Colo.

[73] Assignee: Fluid Dynamics, Inc., Boulder, Colo.

[21] Appl. No.: 826,970

[22] Filed: Feb. 7, 1986

[51] Int. Cl.[4] ..... B01F 5/04

[52] U.S. Cl. ..... 366/336; 366/340

[58] Field of Search ..... 366/336, 337, 340, 167, 366/173, 174, 150, 159, 136, 137, 349, 341; 422/257, 901

[56] References Cited

U.S. PATENT DOCUMENTS

| | | | |
|---|---|---|---|
| 1,992,581 | 2/1935 | Reeder | 366/341 X |
| 2,125,274 | 8/1938 | Gilbert | 366/165 |
| 3,547,410 | 12/1970 | van der Windt et al. | 366/167 X |
| 3,920,552 | 11/1975 | Elkern | 366/340 X |
| 4,345,841 | 8/1982 | Day | 366/341 X |
| 4,448,539 | 5/1984 | Burgert | 366/336 X |
| 4,522,502 | 6/1985 | Brazelton | 366/160 |

*Primary Examiner*—Harvey C. Hornsby
*Assistant Examiner*—Scott J. Haugland
*Attorney, Agent, or Firm*—Angelo Notaro

[57] ABSTRACT

A mixing apparatus is composed of a vertical cylindrical shell having a mixing space divided into multiple pass annular mixing chambers by a concentrically arranged cylindrical shroud, and tubes. An outermost chamber houses a jet nozzle which provides high velocity motive jet tangentially into the annular outer riser chamber, an injector and specially constructed baffles to cause an ascending generally helical mixing to occur. Provisions are made for recirculating part of the mixed fluids from an intermediate downcomer passage to the outer riser chamber.

16 Claims, 8 Drawing Figures

MIXING APPARATUS

BACKGROUND OF THE INVENTION

The invention relates to a mixing apparatus for fluids and, more particularly, to a mixing apparatus for mixing, blending or diluting two or more liquids such as a viscous polymer liquid and water into a substantially homogenous mixture.

It is often desirable to form a substantially homogenous solution of two or more difficult to mix liquids, such as water and oil or polyelectrolytes. Polyelectrolytes are polymers that have a high molecular weight, typically within the range of 1 to 10 million. Polyelectrolytes are often used as flocculating and clarifying agents for the clarification of water and in sewage treatment.

Diluted polyelectrolytes are utilized in industrial water treatment processes. However, such polyelectrolytes are typically shipped to water treatment facilities in concentrated liquid form and then pumped into stirred tanks containing water. The concentrated polyelectrolytes are mixed and diluted with the water by mechanically-operated impellers to make an homogenous solution. Mechanical agitation of such solutions, however, undesirably creates a great deal of shear that detrimentally affects the polyelectrolytes.

U.S. Pat. No. 4,522,502 discloses a mixing apparatus in which an impeller mechanism is mounted within a mixing chamber. The apparatus is designed to mix the polyelectrolytes and water with high torque and low shear so as to cause less damage to the polymer chains comprising the polyelectrolytes.

Nonetheless, utilization of less-intensive mechanically induced mixing, with paddle wheels or short detention time, will result in at least some undesirable side effects including mechanical shearing and, as well, subjects the process to interruptions due to breakdown of the moving parts. The less intensive mixing, moreover, can result in a mixture which is not homogenous.

SUMMARY OF THE INVENTION

In accordance with the invention, a mixing apparatus, having no moving parts, is provided for mixing, blending, or diluting two or more liquids by using a high velocity motive fluid to combine with and drive a second fluid through a series of concentric chambers formed by the cylindrical shell and coaxial cylindrical members within a confined mixing space in the apparatus. The combined liquid flows through an outer riser chamber, in a vertically ascending, generally helical path containing a special deflector construction to produce a mixing action.

The apparatus includes a cylindrically-shaped shroud that extends within the mixing apparatus for a substantial portion of its length and forms the inner wall of the outer riser chamber. The shroud acts as a support for the deflectors and surrounds an inverted tube, concentrically arranged within the shroud, thereby providing an annular downcomer passageway through which the combined fluid descends. Openings are provided through the lower end of the shroud for the recirculation of part of the combined fluid to the outer riser chamber. Centrifugal force causes part of the fluid, particularly higher density portions of the combined mixed fluid, to flow through the recirculation openings into the outer riser chamber wherein it mixes with the motive fluid and the driven fluid. This increases the residence time of high density material so that the material is exposed to further dissolution, mixing and blending. An opening at the lower end of the inverted tube allows passage of the remaining portion of the combined fluid to exit the downcomer passageway and flow upwardly into an inner riser chamber formed between the inverted tube and a central tube disposed concentrically within the inverted tube.

Annular baffle plates are placed within the inner riser chamber and provided with vertically staggered openings to cause further mixing, blending and dilution of the mixed liquid and to increase static pressure in the downcomer passageway. Fluid is discharged from the inner riser chamber into the base of the central tube from which it is ultimately discharged.

The inventive apparatus overcomes disadvantages of prior art devices by using a multipass mixing space with recirculation of the mixture between chambers which divide the space. The preferred four pass mixer arrangement prevents any short circuiting of material being mixed or blended. The motive jet not only imparts energy for mixing, but creates a cyclonic swirl in the outer riser chamber and downcomer passageway.

The inventive apparatus does not use any moving part. The energy required for this mixing and blending is provided by one or more jets that convert the static pressure in the fluid to a velocity pressure. This velocity pressure and the vortex created along the plurality of triangular-shaped or diamond-shaped deflectors mounted in the outer riser chamber causes the two or more streams of different fluids to be combined, divided and recombined. Mixing and blending is accomplished without any external energy except the energy from the motive jet.

The various features of novelty which characterize the invention are pointed out with particularity in the claims annexed to and forming a part of this specification, its operating advantages and the specific objects obtained by its use, reference should be made to the accompanying drawing and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
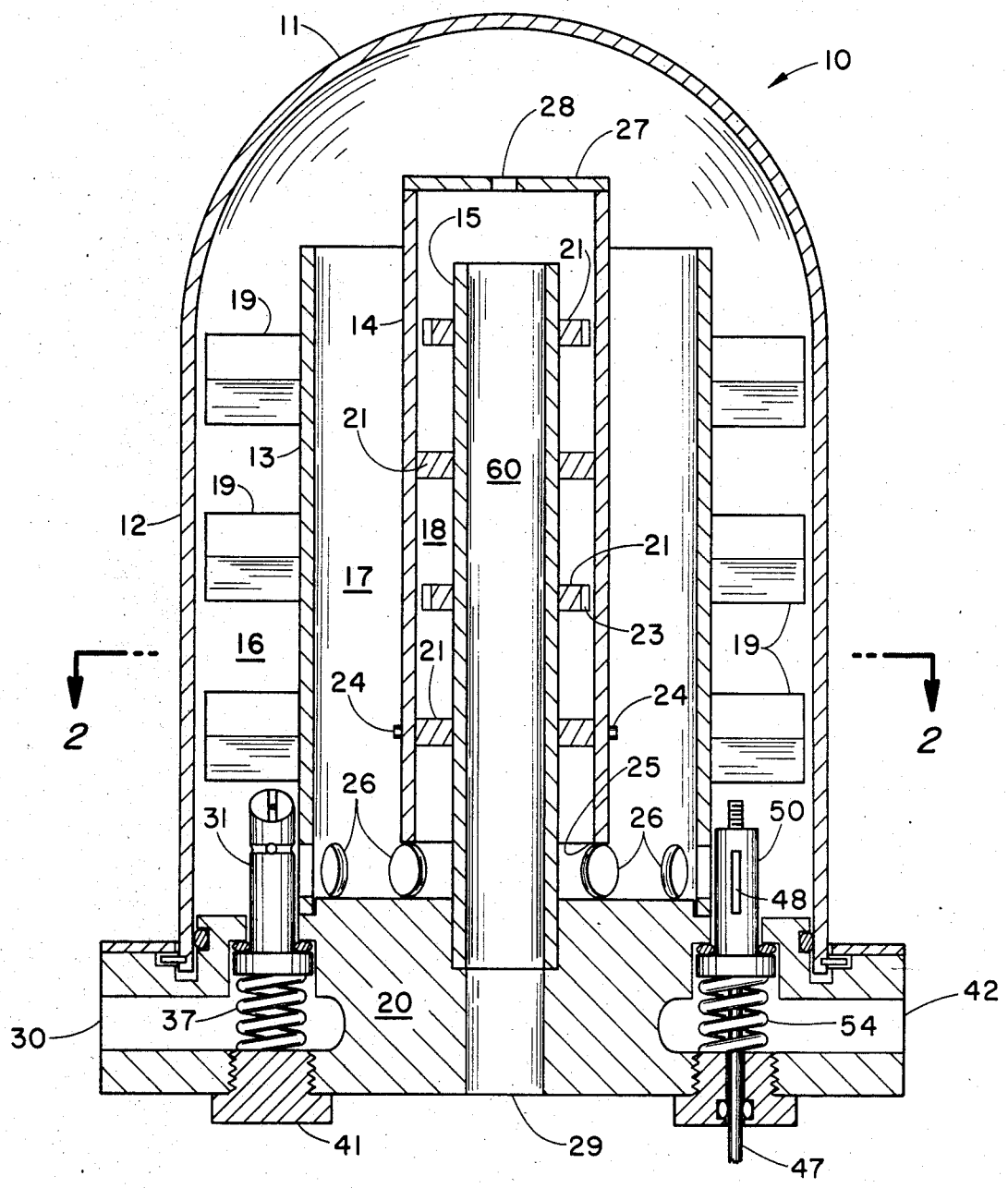
FIG. 1 is a vertical section of a mixing apparatus embodying the present invention.

Referring now particularly to FIG. 1 of the drawings, reference numeral 10 is applied generally to a mixing apparatus comprising an hemispherical head 11 integrally formed atop a vertical, cylindrical outer shell 12 which, in turn, is mounted upon a circular base plate 20. It should be understood that the length of the outer shell will typically be much greater than shown relative to the diameter of the base.

A vertically extending central tube 15 is mounted on the base plate 20 at its center. A cylindrically-shaped shroud 13 is annularly spaced inwardly of the inside surface of the outer shell 12 and forms, in combination with the outer shell 12, an outer riser chamber 16 therebetween. An inverted tube 14 is located between and radially spaced from the shroud 13 and the central tube 15 and forms a downcomer passageway 17 between the shroud 13 and inverted tube 14 and an inner riser chamber 18 between the inverted tube 14 and central tube 15.

A number of flow directing deflectors 19 are positioned in inner riser chamber 16 at vertically staggered positions for dividing and re-dividing fluid flowing through the outer riser chamber 16. In the preferred embodiments of the invention, the deflectors are fixedly connected to the shroud 13 by welding or by other rigid connecting means or integrally formed, for example, as a molded part of the shroud.

Figure 2:
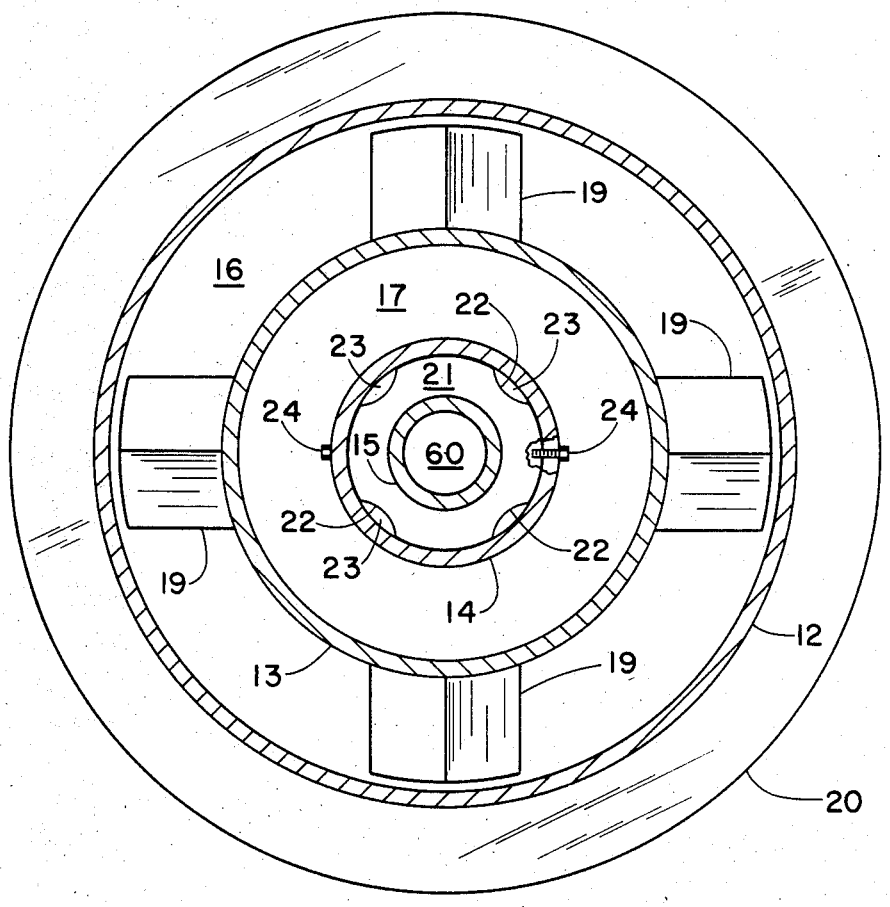
FIG. 2 is a transverse section, partly broken away, taken along view line 2—2 of FIG. 1.

A number of flow directing annular baffle plates 21 are disposed about the central tube 15 at longitudinally spaced intervals. The annular baffle plates 21 transversely extend within the inner riser chamber 18 between the central tube 15 and the inverted tube 14. As is best shown in FIG. 2, each baffle plate 21 is integrally attached at its inner periphery to the central tube 15 in fluid tight relationship. Arcuate shaped recesses 22 are formed along the outer periphery of each baffle plate 21 at peripherally-spaced intervals so that passages 23 are provided between the baffle plates 21 and the inner surface of the inverted tube 14. The passages 23 of vertically adjacent baffle plates 21 are vertically staggered for imparting a tortuous flow path to fluid flowing through the inner riser chamber 18. In the illustrated embodiment, the recesses of the next adjacent baffle plates are rotated by forty-five degrees in respect of each other. Thus, the openings or passages 23 of adjacent plates are longitudinally offset.

Fastening means, such as screws 24, secure the inverted tube 14 to the baffle plates 21 and hold the inverted tube 14 so that the lower end 25 of the tube 14 terminates in a horizontal plane at an elevation closely spaced above the base plate 20.

Closely spaced above the lower end of the shroud 13 and passing through it are a number of ports 26 which afford fluid communication between the outer riser chamber 16 and the lower end of the annular downcomer passageway 17. The lower end of the annular downcomer passageway 17 communicates with the inner riser chamber 18 via the space below the lower end 25 of the inverted tube 14.

The inverted tube 14 is provided with an upper cap 27 that extends over and is spaced above the open upper end of central tube 15. The cap 27 has a vent hole 28 extending through the cap.

The central tube 15 includes a longitudinally extending bore 60 between two open ends and the open lower end communicates with an outlet passage 29 formed through the base plate 20 for delivering the mixed fluid to a point of use.

In the base plate 20, a conduit 30 is provided as a fluid inlet for a fluid that is to be diluted and a conduit 42 provided as a fluid inlet for a motive fluid.

Figure 4:
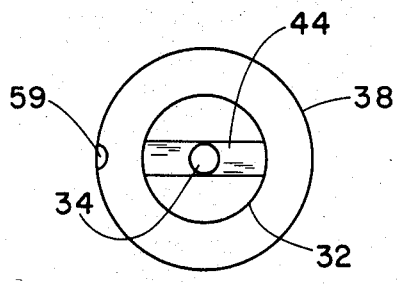
FIG. 4 is a top view of the injector device of FIG. 3.
Figure 3:
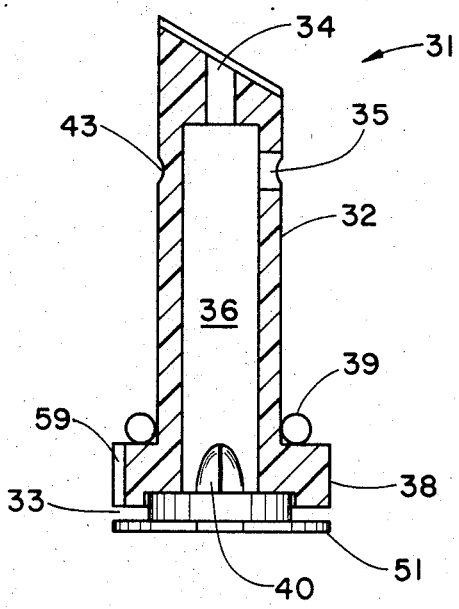
FIG. 3 is an enlarged vertical center section of an injector device used in the apparatus of FIG. 1.

An injector 31, mounted in the conduit 30, allows fluid flow from conduit 30 to the outer riser chamber 16. The injector 31, as is best shown in FIGS. 3 and 4, comprises housing with a stem 32 of any suitable material, preferably PVC plastic or alternately stainless steel, having a first opening 33, an axial second opening 34 and a third opening 35. In operation, fluid to be diluted passes from the conduit 30 into the first opening 33 through an inner fluid receiving chamber 36 and out through openings 34, 35 into the outer riser chamber 16. The injector 31 is spring biased by coil spring 37, or the like, to hold the injector in an operating position. The injector 31 includes an enlarged flange 38 which bears against a passageway peripheral seal 39, such as an O-ring, to seal the space in conduit 30 between the injector 31 and the base plate 20. A duck-bill check valve 40 is provided in first opening 33. A washer 51, connected to the periphery of the check valve 40, is supported by the spring 37. The spring 37 is attached to, at its second opposite end, a plug 41 which is threadably connected to the base plate 20 for ease of removal and insertion of the injector. The check valve 40 allows the flow of fluid from the conduit 30 to the outer riser chambers 16 but prevents backflow.

A circumferential groove 43 is formed on the outside of the stem in communication with outlet 35. A straight groove 44 is formed on the upper face of the injector in communication with outlet 34.

Figure 6:
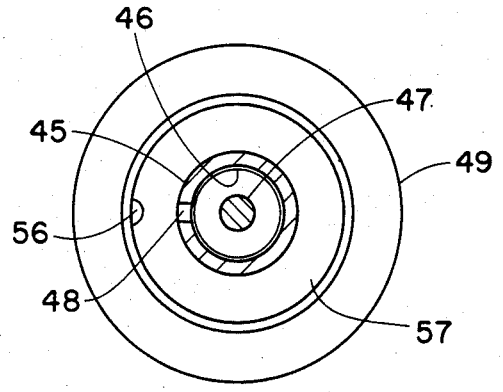
FIG. 6 is a transverse section taken along view line 6—6 of FIG. 5.
Figure 5:
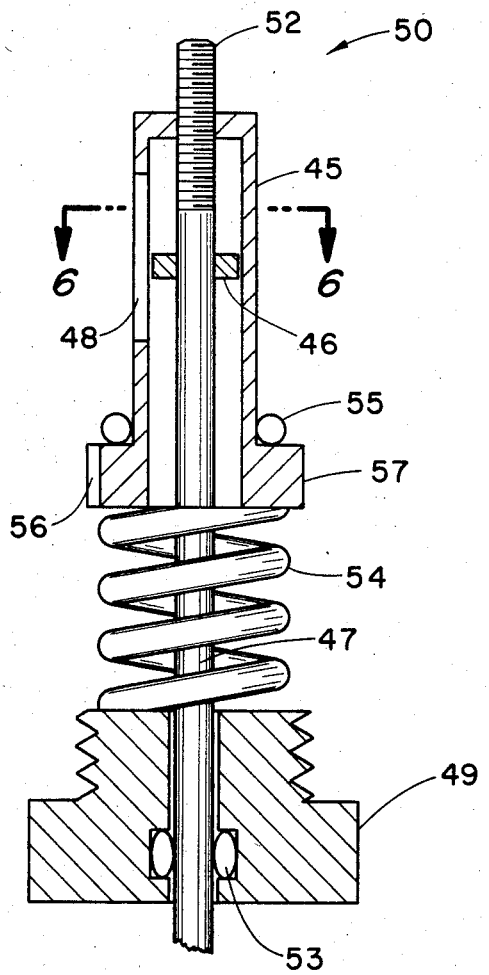
FIG. 5 is an enlarged vertical center section of the jet nozzle and supporting plug arrangement used in the apparatus of FIG. 1.

A jet nozzle 50, as best shown in FIGS. 5 and 6, is mounted in the conduit 42, to allow passage of the motive fluid from conduit 42 into the outer riser chamber 16. The jet nozzle 50 comprises a cylinder 45 including a plug 46 disposed in the cylinder on a control rod 47 separating the cylinder into two chambers. A rectangular shaped orifice 48 extends through the wall of the cylinder. The orifice 48 provides a means for passing fluid entering the cylinder into the outer riser chamber 16. The opening of the orifice 48 may be varied by movement of the plug 46. The upper end of the control rod 47 is threaded at 52 and engaged by a threaded connection to the cylinder so that the height of the plug 46 and, consequently, the area of the fluid discharge opening of the orifice 48 can be adjusted by rotating the rod 47 so that the position of the plug is varied and the plug 46 exposes more or less of the open area of the orifice 48 to motive fluid admitted into the cylinder 45 from conduit 42. The rod 47 extends to the outside of the apparatus 10 through a plug 49 that is threadably engaged in the base plate 20.

The plug 49, as shown in FIG. 5, is provided with an enlarged base that includes a circular recess which contains an O-ring seal 53 which prevents leakage along a path between the surface of the control rod 47 and the opening in the plug 49 through which the control rod passes. A coil spring 54 is mounted around the control rod 47 between the plug 49 and the base of the nozzle 50 to urge the nozzle into sealing engagement against the base plate 20 via a seal 55. A half-circle slot 56 is machined into the base 57 of the nozzle to provide a passage for a pin (not shown) or the like which can hold the nozzle against rotation within the base plate. Thus, the control rod 47 may be engaged externally of the mixing apparatus 10 and rotated during mixing operations to vary the area of the orifice 48. The opening of the orifice 48 is aligned relative to the shroud so that motive fluid is discharged tangentially with respect to the curvature of the shroud. The discharge of the orifice is circumferentially aligned with the radial opening 35 and slot 37 of the injector.

During normal operation, a liquid, such as a concentrated viscous polymer, is received into the outer riser chamber 16 via conduit 30 and injector 31. A motive fluid, such as water, is supplied to the outer riser chamber 16 via the jet nozzle 50 and conduit 42. The motive fluid is discharged from the jet nozzle 50 tangentially relative to the shroud 13 and shell 12 walls and entrains the viscous polymer issuing from discharge openings 34, 35 of the injector 31. Highy viscous fluid will primarily discharge through opening 34 as the pressure head of the jet nozzle discharge flow tends to provide a backpressure against flow from opening 35. A pressure build-up in the injector, for example, due to clogging will cause even a viscous material to be discharged through opening 25.

The discharge of jet nozzle 50 into the outer riser chamber 16 results in the formation of a high velocity area and a low static pressure area at the bottom of the outer riser chamber 16 the discharge orifice 48 of nozzle 50 is arranged above the recirculation parts 26 and oriented for directing the discharge from the nozzle substantially tangent to the outer wall surface of the shroud 13 and the inner wall surface of shell 12 such that the low static pressure area is formed in the vicinity of the recirculation parts to promote fluid flow from the downcomer passageway 17 to the outer riser chamber 16 which move upwardly throughout the outer riser chamber 16 and mix with the liquid discharged from the discharge openings 34, 35 of injector 31 at high velocity in a generally helical path.

Figure 8:
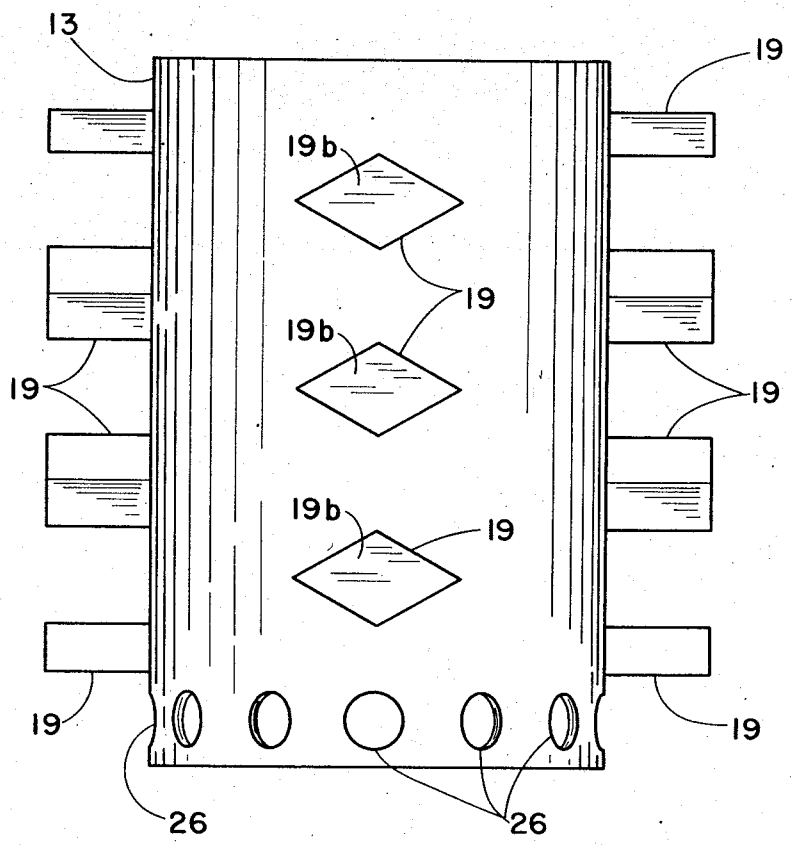
FIG. 8 is a side elevation view of FIG. 7.
Figure 7:
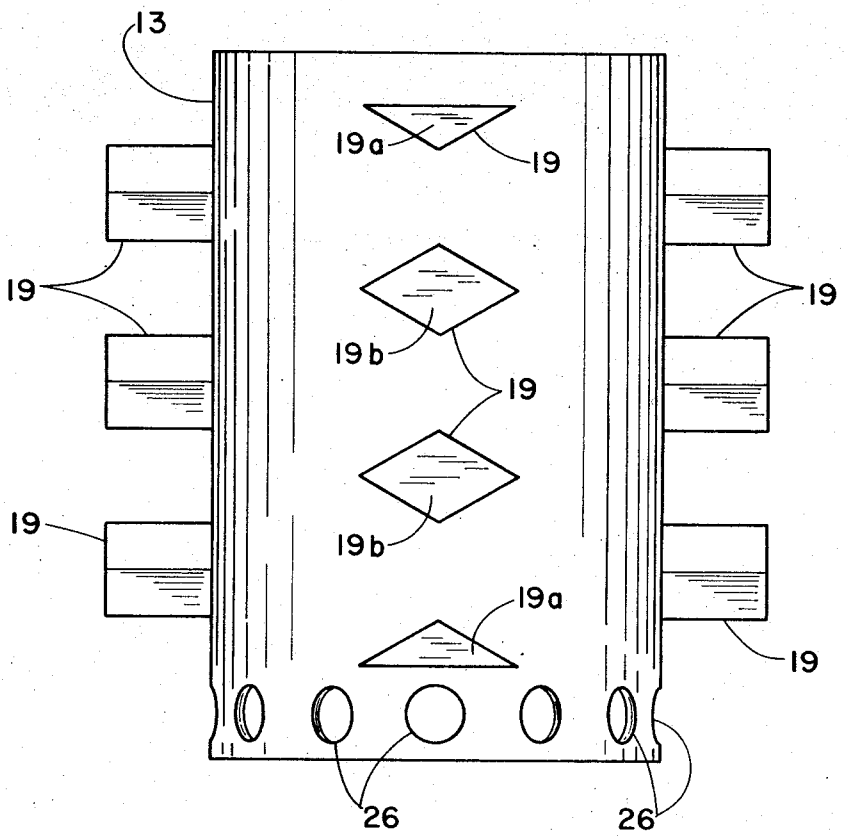
FIG. 7 is a front elevation view illustrating the shroud and the mounting of outer riser chamber deflectors thereto.

The liquids discharged from the injector 31 and jet nozzle 50 are divided and re-divided in the outer riser chamber 18 by the deflectors 19. The deflectors 19, as is best shown in FIGS. 1, 7 and 8, extend across the outer riser chamber at circumferentially and longitudinally spaced intervals and are provided with converging or diverging, triangular-shaped **19*a* or diamond-shaped 19*b* vertical cross sections to promote a high turbulent mixing of the liquids. Other types of deflectors can be advantageously employed in the inventive apparatus and the shape, size and number of the deflectors can be varied to accomplish varying mixing requirements. Thus, for example, radial mixing can be promoted by a delector (not shown) that is curved outwardly from a lower base to a top portion along a central axis parallel to the longitudinal axis of the shroud. This gives rise to diverging streams which rotate in opposite directions, one clockwise and the other counterclockwise. In the illustrated embodiment, the triangular-shaped deflector 19*a* promotes back mixing behind the deflector with relatively high pressure drop. The diamond-shaped deflectors 19*b*** provide alternating areas of flow turbulence and relaxation to enhance the natural mixing of the flow streams.

The mixed liquids are discharged from the upper end of the outer riser chamber 16 downwardly into the downcomer passageway 17 in a helical flow path. At the bottom of downcomer passageway, centrifugal force tends to cause high-density components of the mixed liquid through the recirculation ports 26 into the outer riser chamber thereby increasing the blend time for such components.

The remaining portion of the mixed liquid passes about the lower end of the inverted tube 14 into the inner riser chamber 18. The mixed liquid is directed through a predetermined path in the inner riser chambers 18 by the annular baffles 21 and flow passages 21 formed in the baffles. The flow is passed at the top of the inner riser 16 chamber 18 into the opening upper end of central tube 15 through an longitudinal bore 60 therein and then discharged through the open lower end of central tube 15 and then out of the outlet passage 29.

The velocity of the motive fluid from the jet nozzle 50 and the volume of the fluid will determine the total energy imported into the mixing apparatus 10. The size of the discharge orifice 48 in jet 50 can be adjusted externally, via control rod 47, to vary the pressure drop across this orifice. This feature enables an operator to control the mixing energy within the apparatus 10 and to control the shearing forces that might damage delicate polymers and other types of fragile chemicals. The volume and spacing of the cylindrical chambers 16, 17, 18 can be changed to vary mixing energy gradients. The shape, size and quantity of the dividing deflectors 19 can also be varied to control the mixing energy and the amount of shear within the mixer. The quantity and spacing of the annular baffles 21 in the inner riser chamber 18 can also be varied to increase the mixing energy in this zone.

Testing of the apparatus, using dyes, oil, and particulates, confirmed that centrifugal forces in the downcomer passageway 17 did separate and force these materials to the outer periphery of passageway 17 and cause such to be drawn into the outer riser chamber 16. Dye studies indicated that the effective detention time within the apparatus was increased by a factor of four due to the recirculation ports 26. Testing with oil and cold water demonstrated that with a detention time of 15 seconds, a moderate energy level measured as a pressure drop across the jet of 50 psi and flow rate of 3 GPM, the oil was completely emulsified and did not separate after setting for 24 hours. Side by side tests with a short duration mechanical polymer blending device demonstrated that the inventive apparatus outperformed, as measured by a reduction of polymer usage of 20 to 50%, needed to accomplish the same sludge dewatering on various belt dewatering presses.

It will be apparent to those skilled in the art that changes from the illustrated preferred embodiment may be made without departing from the spirit of the invention claimed.

The invention claimed is:

1. A mixing apparatus for mixing two liquids, comprising:

a base plate;

a vertical cylindrical shell mounted to the base plate and enclosing a mixing space therein;

a cylindrical shroud vertically mounted on the base plate in the shell with an annular outer riser chamber between the shroud and the shell, and having an upper end terminating below the upper end of the shell;

first and second inlet means each directing a stream of a respective one of the liquids into said shell substantially tangent to the inner wall thereof and the outer wall of the shroud so as to move upwardly through the outer riser chamber and at the same time to mix the liquids, outlet means for withdrawing a mixture of the liquids from the mixing space;

a central tube carried by the base plate, said central tube having a longitudinal bore therethrough communicating with the outlet means;

an inverted tube mounted intermediate the shroud and the central tube to define a downcomer passageway between the shroud and the inverted tube and an inner riser chamber between the inverted tube and the central tube, said inverted tube having a lower end terminating above the base plate and an upper end terminating above the upper end of the shroud, said downcomer passageway having opposite ends in fluid communication with said outer riser chamber and said inner riser chamber, and said inner riser chamber being in fluid communication with said bore;

recirculation means for withdrawing a portion of the mixed liquid from the downcomer passageway and directing the said portion to the outer riser chamber; and wherein the recirculation means comprises a plurality of apertures extended through the shroud and opening to the outer riser chamber, said apertures being located below the lower end of the inverted tube.

2. A mixing apparatus as recited in claim 1 wherein the shell, the shroud, the inverted tube and central tube are coaxial.

3. A mixing apparatus as recited in claim 1 further comprising means positioned in the outer riser chamber for deflecting the liquid passing upwardly through the outer riser chamber.

4. A mixing apparatus as recited in claim 3 wherein the deflecting means comprises a plurality of deflectors positioned in the outer riser chamber at longitudinally and circumferentially spaced intervals.

5. A mixing apparatus as recited in claim 4 wherein said deflectors comprise elongated members radially extending between the shroud and the shell, and wherein at least some of said members have a diamond-shaped cross section.

6. A mixing apparatus as recited in claim 5 wherein at least some of said deflectors comprise a triangular-shaped cross section.

7. A mixing apparatus as recited in claim 1 further comprising baffling means positioned in the inner riser chamber having openings for forming predetermined flow passages through the inner riser chamber.

8. A mixing apparatus as recited in claim 7 wherein the baffling means comprises a plurality of annular plates laterally extending between the central tube and the inverted tube, each of said plates having at least one opening extending therethrough for the passage of the mixed liquid.

9. A mixing apparatus as recited in claim 8 wherein each of said plates has a plurality of peripheral openings through each and forms a segment of a flow channel between the plate and the inverted tube.

10. A mixing apparatus as recited in claim 9 wherein a plurality of said plates are fixedly mounted to the central tube at longitudinally space intervals, said peripheral openings of next adjacent plates being longitudinally offset.

11. A mixing apparatus as recited in claim 8 wherein the inverted tube is connected to the plates.

12. A mixing apparatus as recited in claim 1 wherein the first inlet means comprises a spray nozzle mounted in the annular outer riser chamber and defining an adjustable orifice for discharging a first liquid, a first liquid conduit extending through the base plate and leading to the adjustable orifice, a plug movably mounted in the nozzle proximate to the orifice for adjusting the opening of the orifice responsive to the movement of the plug, and a control rod connected to the plug and being extended to the outside of mixing apparatus whereby the plug may be moved from outside of the mixing apparatus.

13. A mixing apparatus as recited in claim 12 wherein the orifice comprises a rectangular opening.

14. A mixing apparatus as recited in claim 12 wherein the second inlet means comprises an injector having a discharge means comprising a first discharge opening for discharging a second liquid, a second liquid conduit extending through the base plate connected to the discharge means, and said first discharge opening being circumferentially in line with the discharge of the adjustable orifice.

15. A mixing apparatus as recited in claim 14 wherein the discharge opening comprises an axial opening in the injector.

16. A mixing apparatus as recited in claim 12 wherein the adjustable orifice is positioned above the apertures.

* * * * *